United States Patent [19]

Nigrelli et al.

[11] Patent Number: 4,531,345

[45] Date of Patent: Jul. 30, 1985

[54] CASE LOADER

[76] Inventors: Nicholas B. Nigrelli, 13234 Westview, Cleveland, Wis. 53015; Terry J. Nigrelli, 16024 Highway X, Kiel, Wis. 53042

[21] Appl. No.: 438,214

[22] Filed: Nov. 1, 1982

[51] Int. Cl.[3] ..... B65B 5/06; B65B 5/08

[52] U.S. Cl. ..... 53/534; 53/543; 53/247

[58] Field of Search ..... 53/246, 247, 248, 251, 53/253, 534, 543, 300; 198/477, 725

[56] References Cited

U.S. PATENT DOCUMENTS

| | | | |
|---|---|---|---|
| 2,615,289 | 10/1952 | Hickin . | |
| 2,783,869 | 3/1957 | Thurman . | |
| 2,978,854 | 4/1961 | Fairest | 53/246 |
| 3,194,382 | 7/1965 | Nigrelli et al. . | |
| 3,599,397 | 8/1971 | Standley | 53/534 X |
| 3,864,890 | 2/1975 | Ullman . | |
| 4,408,436 | 10/1983 | Glover | 53/248 X |

*Primary Examiner*—Horace M. Culver

*Attorney, Agent, or Firm*—Fuller, House & Hohenfeldt

[57] ABSTRACT

A case loader for loading pet beverage or other product bottles with a prominent neck flange in cases includes support rails spaced by gaps which support the bottles by the neck flange in suspended condition as they are moved by pusher bars from a grouping station to a case filling station.

15 Claims, 5 Drawing Figures

CASE LOADER

BACKGROUND OF THE INVENTION

1. Field of the Invention

This invention pertains to apparatus for loading open top cases, and more particularly to apparatus for loading open top cases with complements of separate upright articles that are transported and guided to the cases along stationary guide loading tracks. More specifically, the invention relates to loading apparatus for bottles made from polyethylene terepthalate and called "pet bottles" in the trade.

2. Description of the Prior Art

Various equipment has been developed to automatically load open top cases with upright articles such as bottles and cans. Examples of prior case loading machines are discussed in U.S. Pat. Nos. 2,615,289; 3,194,382; 3,599,397; and 3,864,890.

An important part of a case loading machine is the means employed to handle the individual articles for proper insertion into a case. Prior handling and inserting means include electromagnetics, as illustrated in U.S. Pat. No. 3,194,382. The limitations of an electromagnetic handling system are readily apparent. A common means for handling and inserting individual articles consists of mechanical gripping devices of various designs. Typically, a gripper consists of a jaw-like mechanism adapted to grip the upper portion of the article, to insert the article into a case, and to release the articles at the proper time and location. U.S. Pat. Nos. 2,615,369; 2,783,869; and 3,864,890 are illustrative of the various gripping devices utilized for handling and inserting bottles. It will be appreciated that several problems are inherent with mechanical grippers. The grippers of necessity are assembled from numerous small parts. The resulting mechanism is therefore expensive, complicated and prone to malfunction. The jaws must exert a gripping force that is neither too weak nor too strong. The timing of the opening and closing of the jaws as they grip and release the articles is critical. The relative locations of the jaws and articles must be very carefully controlled for proper gripping operation. None of the prior art techniques have been found suitable for loading the new pet plastic soft drink bottles having a pronounced neck flange.

SUMMARY OF THE INVENTION

The present invention provides simple, inexpensive and reliable means for automatically inserting complements of articles into an open top case, particularly the pet bottles. The invention includes a pair of guide loading tracks adapted to receive and support a portion of the articles to be loaded. The guide loading tracks remain stationary during all phases of the case loading operation. A complement of flanged containers is guided along the guide loading track by a conventional pusher bar of simple construction. The guide loading track is preferably fitted with low friction surfaces on which the flanged container slides. At least the outlet of the guide loading track is inclined relative to a case transporting conveyor means. Open top cases are conveyed in a path which is located beneath the article path and intersects the path of the articles so that the cases are in proper location to receive the complement of articles. In one embodiment of the invention, a section of the guide loading track is inclined such that the containers are urged downward by gravity, and relatively stiff bristled brushes are positioned on both sides of the guide loading track to contact the articles and serve as motion retarding devices and prevent free fall of the articles.

Further objects, advantages and features of the invention will become appparent from the disclosure.

DESCRIPTION OF THE DRAWINGS

Further description of the present invention will appear when taken in conjunction with the accompanying drawings, in which.

DETAILED DESCRIPTION OF THE INVENTION

Figures 2, 3, 4, 5:
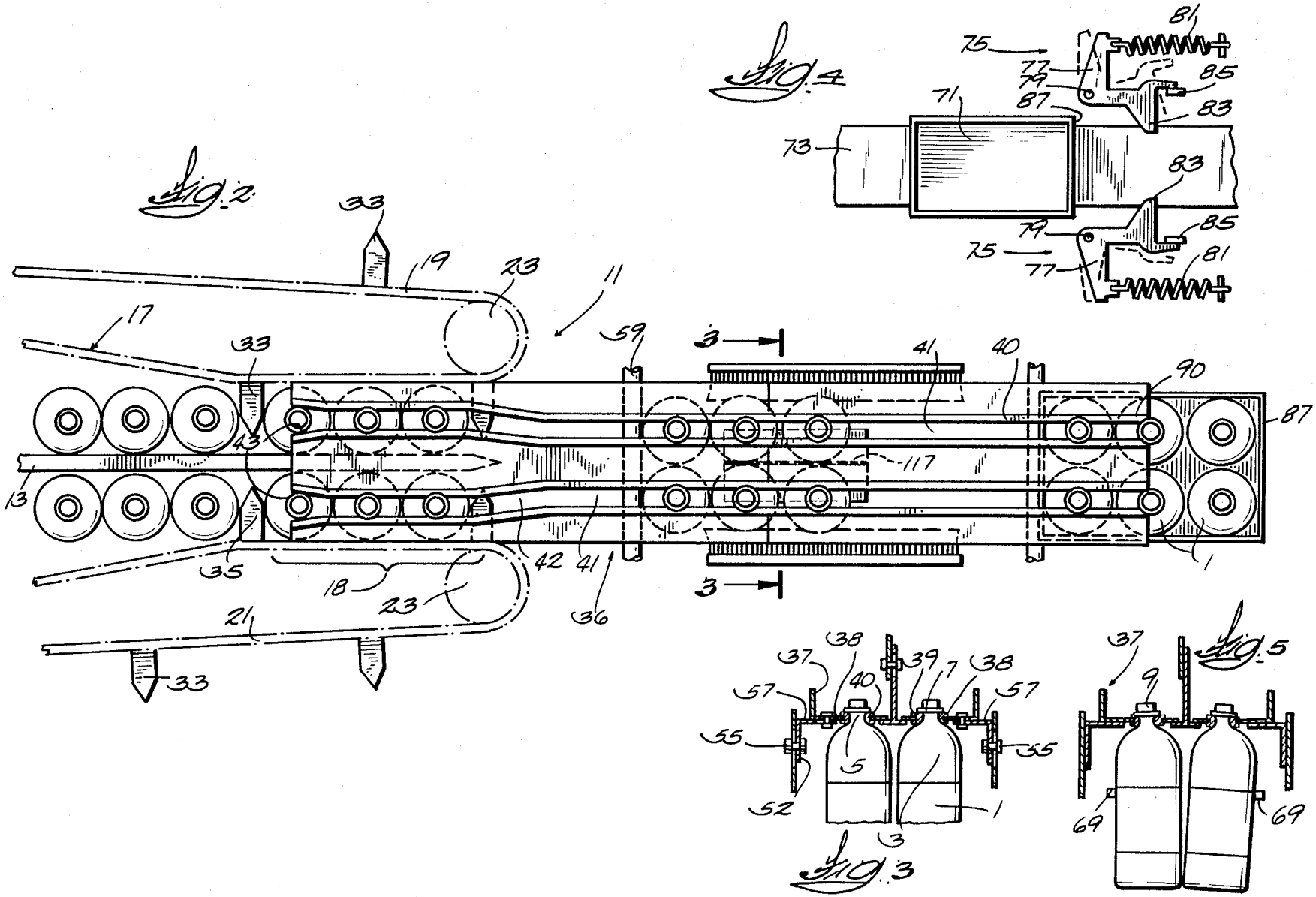
FIG. 2 is a top view of the case loading machine of FIG. 1 showing bottles in two rows being loaded into a case.
FIG. 3 is a partial sectional view taken along line 3—3 of FIG. 2.
FIG. 4 is a top view of a case holding fingers taken along line 4—4 of FIG. 2.
FIG. 5 is a view similar to FIG. 3 showing the guide rails adjusted to facilitate entry of the bottles into a carton.

The preferred embodiment of the present invention finds particular usefulness for handling and inserting pet bottles into open top cases in a case loading machine. As shown in FIG. 3, a pet bottle 1 consists of a body portion 3 which typically tapers in a non-uniform manner into a relatively slender neck 5. A neck flange 7 extends laterally around the circumference of the neck. The neck terminates with conventional closure means such as a screw cap 9. It will be appreciated that the particular shape of the bottle below the neck 5 is not critical, nor is the bottle material or contents. The neck flange results from the method of forming the bottle.

Referring to FIG. 2, reference numeral 11 indicates a case loading machine. Filled and capped bottles 1 are fed to the machine by a conventional conveyor, not shown, into the infeed section of a packing station, not shown, where the bottles tend to bunch. In the packing station, the bunched bottles are divided into two paths by center lane divider 13. Infeed conveyors 15 of conventional design, FIG. 1, support the bottles between the packing station and a grouping station 17.

In the grouping station 17, the bottles 1 are grouped into complements 18, FIG. 2, of the desired number of bottles. The present invention will be described in conjunction with a complement of six bottles composed of two rows or lanes of three bottles each. Apparatus with three or more lanes would operate in accordance with the invention. However, it is to be understood that the scope of the invention is not limited to the particular complement of bottles described herein. On the contrary, the invention is intended to embrace all article handling and inserting apparatus and applications that fall within the scope of the appended claims.

Grouping station 17 includes a pair of grouper meter chains 19, 21. Grouper chain 19 travels counterclockwise with respect to FIG. 2 about sprockets 23. Grouper chain 21 travels clockwise with respect to FIG 2 about sprockets 23 in synchronization with grouper chain 19. A plurality of corresponding outwardly projecting metering lugs 33, 35 are fastened to chains 19, 21, respectively. The lugs on each chain are spaced apart by a distance slightly greater than the sum of the lateral dimension of the complement of articles to be loaded. In the embodiment illustrated, the spaced apart distance of the metering lugs is slightly greater than three times the diameter of a pet bottle. In the grouper station 17, the chains 19, 21 converge toward each other in the direction of the chains' motion. As the chains traverse past the grouping station, the lugs penetrate the bunched bottles to form complements of six bottles consisting of two rows with three bottles in each row. Infeed conveyor 15, FIG. 1, supports the bottles as they are transported from the grouping station to the guide loading tracks.

In accordance with the invention, a complement of bottles is simply and efficiently transported and guided from the grouping station to a waiting open top case by means of the guide loading tracks 36. In the present embodiment, the guide loading tracks consist of a pair of side guide rails 37 with planar supporting portions 38, FIG. 3, and an intermediate planar rail 39. The guide and intermediate rails 37, 39 are cooperatively located so as to form a pair of longitudinally extending slots 41 which are slightly wider than the diameter of the bottle necks 5 but substantially narrower than the diameter of flanges 7 to support the flanges 7 thereabove. Means are provided to afford lateral and vertical adjustment of the rails 37, 39 to accommodate different size bottles and adjust the size of the gaps and spacing of gaps between adjacent lanes. In the disclosed construction, the means comprises brackets 52 with a bolt and slot adjustment 55, with the brackets also having a horizontal portion 57 with a bolt and slot connection to the rails 38. Similar adjustment capability can be provided for the center rail 39.

The upstream end of the slots 41 may be tapered or provided with a flared entrance at 43 to aid in guiding the bottle necks into the slots. Metering lugs 33, 35 urge the complement 18 of bottles from the grouping station to the guide loading tracks 36. As illustrated in FIG. 2, the slots of the guide loading tracks are formed with jogs 42. The jogs begin in the region where the center lane divider 13 ends. The slots on the downstream side of the jogs are spaced apart such that the distance between them is slightly greater than the diameter of a bottle to position the bottles in close side-by-side relationship prior to the deposition of the bottle complement in a case. The bottles can be cocked at an angle, as illustrated in FIG. 5, to even further reduce the width of the lower portion of the bottle complement to facilitate entry of the bottles into a case by appropriate spacing of the slots.

Means are provided to move the bottles from the grouping station to the case loading station. In the disclosed construction, the bottles are moved along the guide loading tracks by an overhead flighted pusher bar assembly 45, FIG. 1. The pusher bar assembly 45 consists of a pair of similar laterally spaced chains 47, only one of which is shown. The chains travel in unison in a counterclockwise direction with respect to FIG. 1 over sprockets 49, 51, 53 and 55 under direction from conventional drive means 57. Longitudinally spaced apart pusher bars 59 are fastened at either end to a chain 47. The distance between pushers bars 59 can be equal to or greater than the spacing between metering lugs 33 and 35 of chains 19 and 21, respectively. The chains 47 travels in synchronization with grouper chains 19, 21 so that a pusher bar 59 enters the space between complements 18 of bottles generated by lugs 33, 35 at the location behind the last bottle of the complement as it enters the guide loading track 36. At this point the pusher bar is travelling downwardly and forwardly around the curve so it gently engages the bottle complement. The pusher bar follows the lugs in the space above the lugs. When the lugs release the bottles at sprockets 23, the pusher bars continue to push the suspended bottles through the case loading machine until they are deposited in a case.

Figure 1:
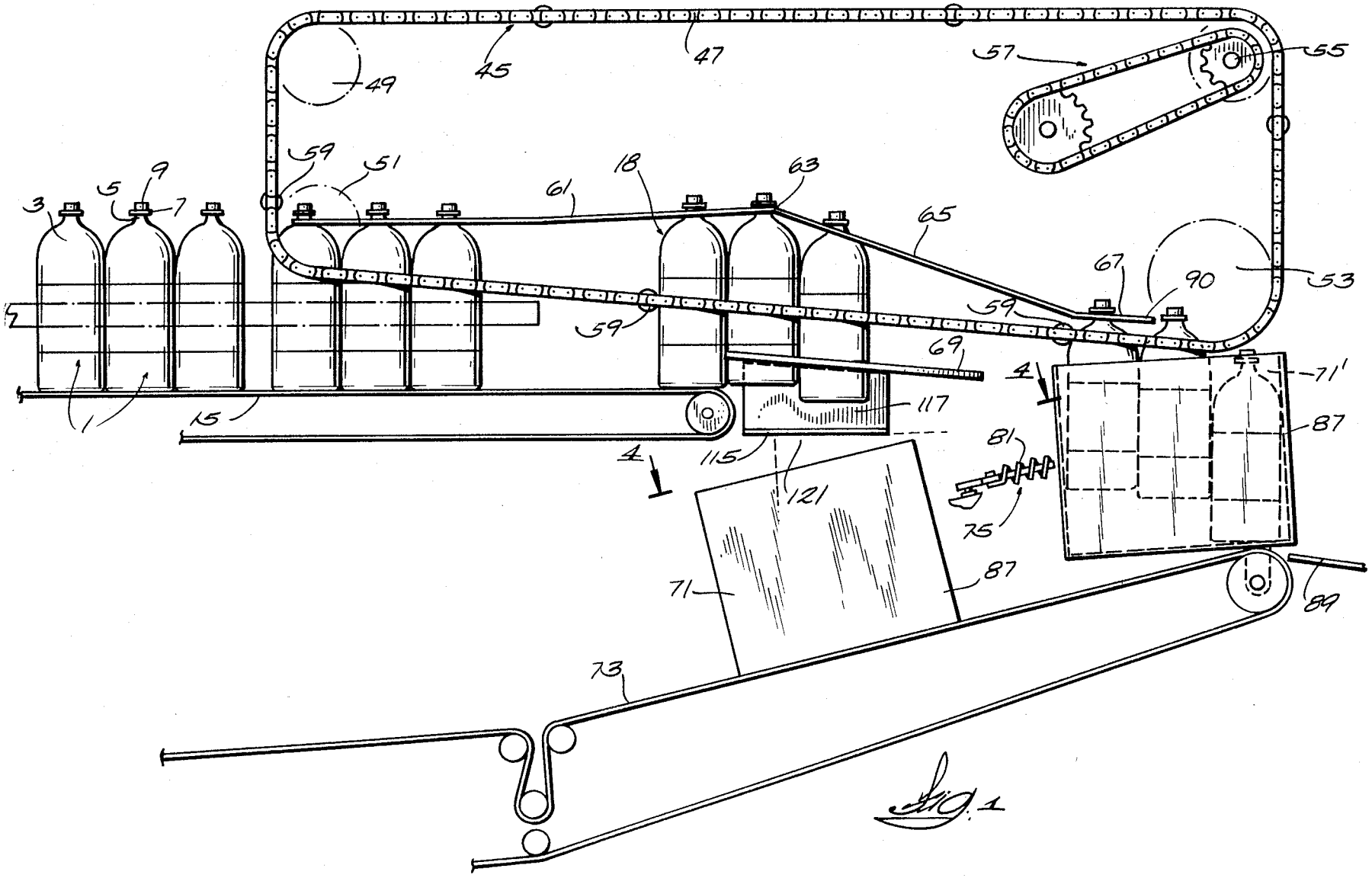
FIG. 1 is a diagrammatic side view of a case loading machine for loading flanged bottles into open top cases.

In a preferred embodiment of the present invention, a section 61 of the guide loading track 36 rises slightly with respect to the chain 15 in the direction of bottle motion, FIG. 1. This elevates the bottles above conveyor 15 prior to the bottles reaching the end of the conveyor 15 so that the bottles are propelled only by the flight bars 59. This insures that the pusher bars gradually take over control of the bottles prior to reaching the end of conveyor 15. This provides positive control of bottle movement to prevent tipping of the bottles. As a result, the bottles are suspended by their flanges 7 as they are pushed along section 61. From apex 63, the guide loading track preferably continues at section 65 which slopes downwardly in the direction of bottle movement. The guide loading track terminates in a relatively horizontal section 67. It is possible that the bottles may slide down section 65 in a free fall ahead of pusher bar 59. To prevent that possibility, a stiff bristled brush 69 is positioned on either side, or on both sides, of the path travelled by the bottles. The brushes act as frictional motion retarding devices or a brake that prevents free fall of the bottles and affords controlled descent.

As a complement 18 of bottles descends track 65, the bottles enter an empty open top case 71. The slope of track 65 minimizes bottle dropping distance. The case was previously transported along a conventional conveyor 73. The conveyor 73 can be driven by an independent motor, not shown. The empty cases are stopped at the proper loading location relative to the guide loading track by restraining means which in the disclosed construction consists of a spring loaded case stop assembly 75, FIG. 4. The case stop assembly prevents conveyor 73 from further transporting case 71, and conveyor 73 merely slides past the bottom of the case, with the case skidding thereon. The stop assembly 75 consists of a pair of levers 77 pivotable about pins 79. Springs 81 bias fingers 83 into the path of travel of the case. Stops 85 limit the inward movement of the fingers. The speed of conveyor 73 is desirably equal to or less than the speed of the pusher bars.

The guide loading track partially inserts the complement 18 of bottles into the open top case at the loading position. The pusher bar 59 continues to push the two trailing bottles so that the two leading bottles press against the leading or front end 87 of case 71 to force the case through the case stop 75 against the springs 81. In addition, the friction of conveyor belt 73 on the bottom of the case assists in overcoming the case stop. As the pusher bar transports the bottles along the remainder of section 65, the bottles gradually penetrate deeper into the case. When the leading bottles reach section 67, the bottles tilt the cases into an upright position, as indicated by reference numeral 71' of FIG. 1. Continued motion by pusher bar 59 pushes the bottles off the guide loading track, and the bottles settle the short distance to the bottom of the case as the bottles leave the support of the planar guide portions 38, 39 of the guide rails at the end 90 of the guide rails. Finally, the pusher bar pushes the loaded case down skatewheel conveyor 89 for further processing.

For ease in pushing the loaded bottles through the guide loading track 36, the track areas that support the bottle flanges 7 may be covered with an antifriction material. For example, the side guide rails 37 and the intermediate guide rail 39 may be fitted with U-shaped strips 40 of Teflon brand polymer, as shown in FIG. 3.

To maintain control of the cartons 71 as they are engaged by the lead bottles, a guard plate 115 is provided which is fastened to the machine frame (not shown). The guard plate 115 has an upstanding central fin 117 which separates and maintains the bottles in the side-by-side rows. The guard plate 115 is positioned to engage the top and rear of a carton 121, shown in broken lines, to prevent the carton from tipping forwardly and maintain a generally horizontal attitude for the carton as all of the initial bottles nest in the carton.

Thus, it is apparent that there has been provided, in accordance with the invention, a guide loading track for automatically inserting complements of articles into open top cases that fully satisfies the aim and advantages set forth above. The control of the various functions, grouping, separating, depositing and case positioning are all controlled by the relative speed of the components and the mechanical movements thereof. No sensors or timing controls are required. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A case loader for loading articles having laterally extending neck flanges into a case comprising:

a. grouper means for grouping the articles having such flange into a complement of a selected number of articles, the articles being disposed along at least one conveying path;

b. support means for supporting the articles in the grouper means;

c. at least one pair of guide tracks arranged with respect to the conveying path and spaced by a gap less than the diameter of the neck flanges and greater than the diameter of the article neck to receive the necks of the articles in the gap between the tracks and support the articles under the neck flanges; and d. means for moving the complement along the guide tracks from the grouper means to a case loading station and for separating each article in the group individually from the guide tracks at the loading station for loading the complement into the case, said guide tracks being inclined upwardly from the plane of the support means to cause lifting of the articles from the support means as the articles are moved along the guide tracks and the upward inclination of the guide tracks affording grouping of the complement in close contact.

2. The case loader of claim 1 including means to adjustably position said guide tracks.

3. The case loader of claim 2 wherein the guide tracks include a downwardly inclined section for guiding the complement into the case to minimize the drop of the articles into the case.

4. The case loader of claim 3 wherein restraining means are located adjacent the downwardly inclined section to prevent free fall of the articles in the complement and away from each other.

5. The case loader of claim 4 wherein the restraining means comprise bristled brushes arranged to retard the movement of the complement.

6. The case loader of claim 4 which further comprises:

e. upwardly inclined case conveyor means for conveying the case along a path that intersects the complement of articles at the loading station to further minimize the drop of the articles into the case.

7. A case loader in accordance with claim 1 wherein there are two spaced slots defined by said guide rails to simultaneously convey and load pairs of articles in side-by-side relationship.

8. Apparatus for transporting complements of bottles having laterally extending neck flanges comprising a pair of opposed guide rails having planar portions having adjacent edges, said edges being spaced by a gap to receive the neck of the bottle therebetween, with the bottle flange spanning the gap and supported on the planar surfaces of said rails, said guide rails having an upwardly inclined inlet section and a downwardly inclined discharge section, and pusher means to propel the complements of bottles along said guide rails whereby such complements of bottles will be initially grouped in close contact by the inclined section of the guide rails.

9. The apparatus of claim 8 wherein said guide rails have tapered inlet edges to facilitate entrance of the bottles between the rails.

10. Apparatus in accordance with claim 9 wherein there are two spaced bottle receiving gaps with a common rail therebetween.

11. A case loader in accordance with claim 8 including restraining means comprising brushes located on each side of the downwardly inclined sections of the guide rails.

12. A case loader for loading articles having laterally extending neck flanges into a case comprising first conveyor means for transporting articles to be loaded into said cases along a path of travel, second conveyor means for grouping said articles into complements of selected numbers of articles, a pair of guide tracks spaced apart a distance less than the diameter of said neck flanges and located in the path of travel of said articles, said guide tracks having an upwardly inclined inlet section, a downwardly inclined loading section, and a horizontal discharge section, means for conveying cases along a path to receive said complements of articles as the articles are discharged from the guide rails, and third conveyor means for pushing said complements of articles into said guide rails whereby said articles are lifted off of the second conveyor means and grouped into close contact in the upwardly inclined section of the guide rails, aligned with the cases by the downwardly inclined section and discharged separately into the cases from the discharge section.

13. The case loader according to claim 12 including restraining means on each side of said downwardly inclined section for maintaining the articles in close contact on descent into the cases.

14. The case loader according to claim 13 including means for restraining the cases on said case conveyor at the discharge end of said guide rails whereby said cases are released from said restraining means on engagement by said articles.

15. The case loader according to claim 14 including means for preventing the cases from tipping on engagement by said bottles.

* * * * *